US005862909A

United States Patent [19]

Jacobsen

[11] Patent Number: 5,862,909

[45] Date of Patent: Jan. 26, 1999

[54] LOCKING APPARATUS FOR GOLF CLUBS

[76] Inventor: Norman T. Jacobsen, 10924 SE. Stonehill La., Hobe Sound, Fla. 33455

[21] Appl. No.: 914,530

[22] Filed: Aug. 19, 1997

[51] Int. Cl.[6] ..... A63B 55/00

[52] U.S. Cl. ..... 206/315.3; 70/58; 211/70.2

[58] Field of Search ..... 206/315.3; 211/70.2, 211/4; 248/551, 553; 70/57, 58, 59, 61, 62, 14, 25, 39, 38 A, 38 B

[56] References Cited

U.S. PATENT DOCUMENTS

| | | | |
|---|---|---|---|
| D. 336,603 | 6/1993 | Penaflor | D8/336 |
| 877,676 | 1/1908 | Snook | 70/39 |
| 949,809 | 2/1910 | Sheen | 70/62 |
| 1,717,959 | 6/1929 | Cauffman | 206/315.6 |
| 4,538,728 | 9/1985 | Lewis | 206/315.3 |
| 4,540,092 | 9/1985 | DeSantis | 70/59 X |
| 4,863,019 | 9/1989 | Lewis et al. | 206/315.3 |
| 5,004,100 | 4/1991 | Smith | 206/315.3 |
| 5,590,772 | 1/1997 | Schuhlen et al. | 206/315.3 |

*Primary Examiner*—Jes F. Pascua
*Assistant Examiner*—Tri M. Mai
*Attorney, Agent, or Firm*—McHale & Slavin,

[57] ABSTRACT

A golf club locking device is provided to lockingly secure two or four golf clubs within a golf bag. A central member having arms extending from opposite sides is provided with a key lock. The key lock is operatively connected to a bar which rotates upon the turning of the key. Each extending arm includes one or two slots for fitting the narrow end of the golf club shaft therein. Upon rotating the locking key bar, the slot opening is closed to prevent removal of the golf clubs.

16 Claims, 2 Drawing Sheets

LOCKING APPARATUS FOR GOLF CLUBS

BACKGROUND OF THE INVENTION

1. Field of the Invention

This invention relates in general to the field of golf club locking devices and in particular to the field of locking apparatus attached to a golf club bag to prevent theft of two or more golf clubs such as a driver and a putter.

2. Description of the Prior Art

Golf clubs like many other devices have advanced in performance and design due to the vast increases in technology over the past decade or so. However, technology is not without cost because along with the technological advances, the purchase price of golf clubs has significantly risen. Both factors, characteristically have given rise to increases in the pilferage of the technologically advanced and costly golf clubs over the same period of time.

Modern golf clubs consist of a matched set of irons and woods. The irons range in numbers from one through nine while woods generally range in numbers from one through four. Woods can, however, continue in numbers five through nine. Typically there are two golf clubs which command special attention to the golfer and to the golf club manufacturers. These are the driver and the putter. Because technology has focused in on these two clubs in particular, the desirability and the price of a driver and a putter has increased even beyond the price of modern and expensive golf clubs. A single driver can cost as much as three hundred dollars. A single putter can cost as much as one hundred or more dollars. As a result, these two clubs in particular are very subject to being stolen.

The putter and driver can be stolen from automobiles, public and private golf courses, during traveling or any other situation where the clubs or golf bag are left unattended for a brief period of time. Typically, the clubs are stolen from golf bags which contain all of the clubs of a golfer. For example, while a golf bag is on a golf cart, or at a golf rack along with dozens of other bags, or the golf club bag is being handled by a valet who takes the clubs to and from the golfer's car, or any other time where the clubs are left unattended for a brief period of time, a person can easily take the putter and the driver from a bag without being noticed. In such a situation, the inconvenience to the golfer is significant. He has lost the two clubs upon which he most depends and must endeavor to obtain replacements which will never be exactly the same as the missing clubs. He will lose the ability to use the particular clubs which are stolen when playing a round of golf. He will also be out the high cost of the stolen clubs.

While there may be golf club locking devices which have been previously invented, to the inventor's knowledge there is no device on the present market which is being used to prevent theft of the driver and the putter. In all probability the reasons for the non-use are lack of simplicity, convenience and effectiveness. The present invention provides a complete solution to the problem of stolen drivers and putters; it is very convenient to use; it is simple in construction; it is inexpensive, and can be adapted to both existing golf club bags and new golf club bags. Thus, the inventive apparatus can be sold separately or it can be manufactured as part of the golf bag.

The above-stated objects as well as other objects which, although not specifically stated, but are intended to be included within the scope the present invention, are accomplished by the present invention and will become apparent from the hereinafter set forth Detailed Description of the Invention, Drawings, and the Claims appended herewith.

SUMMARY OF THE INVENTION

According to the present invention, a device for locking two, or perhaps, four specialty golf clubs within a golf bag is provided. The locking apparatus is fixedly attached to a golf bag such that it is substantially impossible to remove the apparatus. In this regard, a flanged member, which is attached to the locking device, is mechanically fastened to the golf bag. The locking apparatus comprises a box member having one to two slots on the side thereof with a rotatable bar covering the opening to the slots. The rotatable bar is connected to a key lock which locks the bar in the position when the bar covers the opening to the slots. The size of each slot is such that it is larger than the narrow upper part of the golf club shaft but smaller than the thicker grip portion of the shaft.

In accordance with the above, there has been summarized the more important features of the present invention in order that the detailed description of the invention as it appears in the below detailed description of the same, may be better understood.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
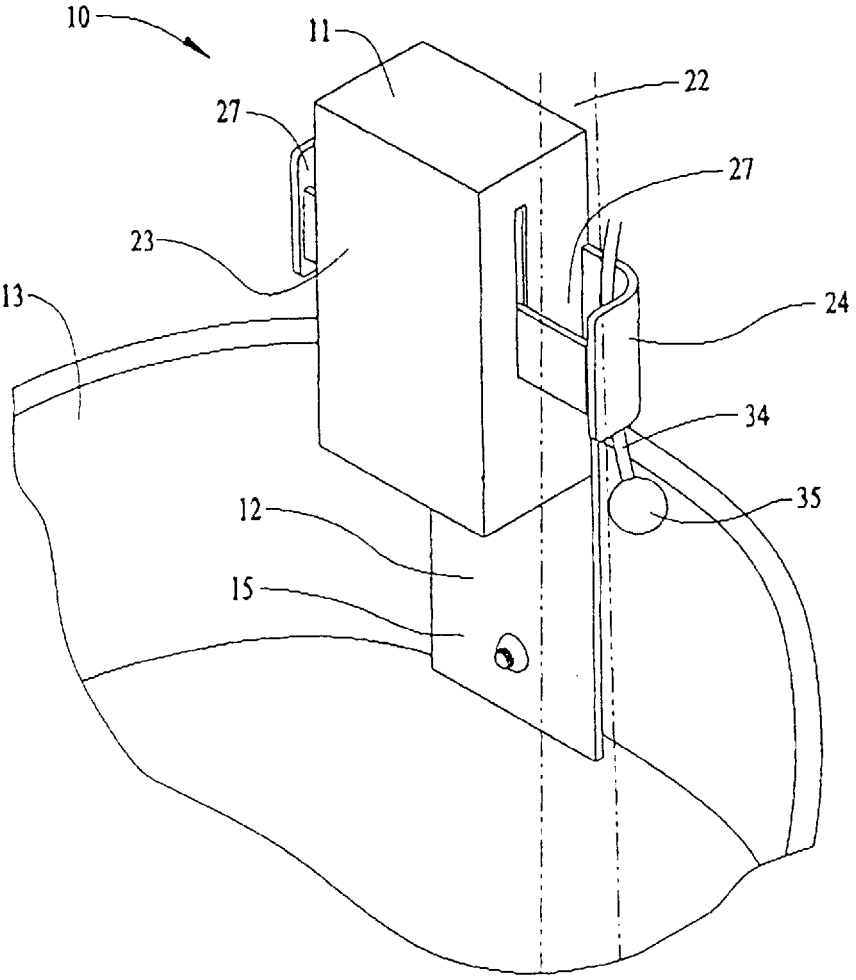
FIG. 1 is a pictorial view of the lock of the present invention, in use on a golf bag.
Figure 2:
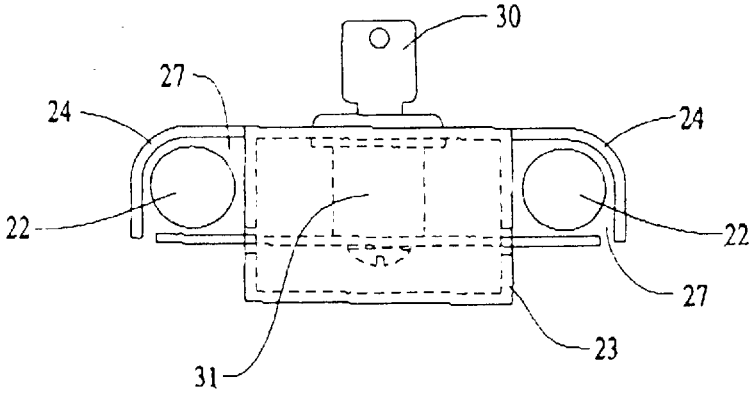
FIG. 2 is a top plan vie of the lock shown in FIG. 1.

As required, detailed embodiments of the present invention are disclosed herein; however, it is to be understood that the disclosed embodiments are merely exemplary of the invention which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals. Reference is now made to the various figures of the drawings which taken together depict a preferred embodiment of the invention. A locking box member 11 has attached thereto attaching member 12. Attaching member 12 is one of many members which can be used to attach the locking box 11 to a golf bag 13 and therefore is not to be restricted to that shown and described.

In the embodiment shown, attaching member 12 comprises a strip of a metallic material bent across the narrow dimension into a "U" shaped member when viewed from the side thereof The space 14 between the extending sides 15 and 16 is approximately that of the thickness of the cylindrical shell of the golf bag 13. The "U" shape of the attaching member 12 provides a convenient means to account for variations in the thickness of different golf bags. The side members 15 and 16 may be further spaced apart or more closely spaced apart to fit a particular golf bag. The length and width of attaching member 12 is not critical.

Figure 5:
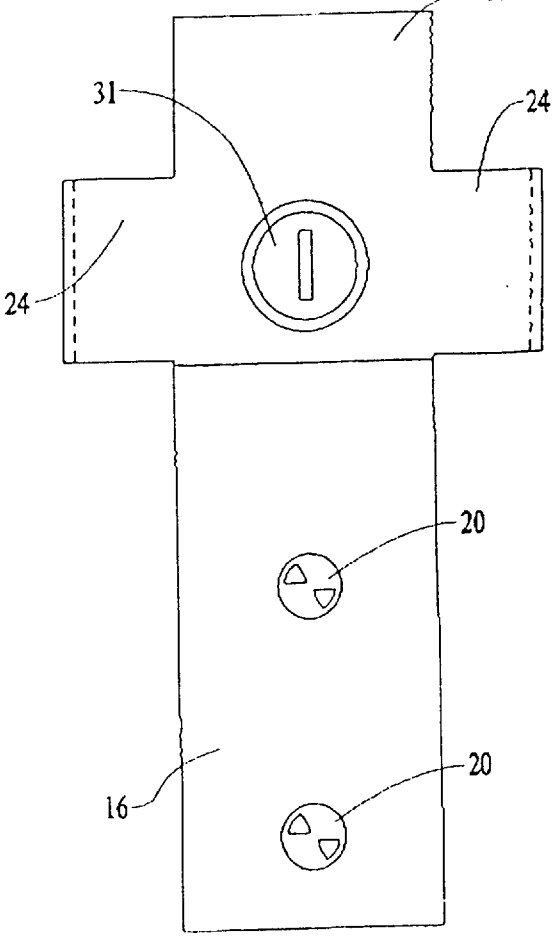
FIG. 5 is a front view of the lock shown in FIG. 1.

Attaching member 12 may be attached to the golf bag 13 by a pair of ordinary machine screws 17 and nuts 18. Although it is highly doubtful that a would-be thief would have the time and means to unfasten the nuts 18 from screws 17, a more secure arrangement is possible. The more secure arrangement is shown in FIGS. 5 and 6. In this embodiment, a blind nut 19 having a plain round head is used in conjunction with a tightening only screw 20; i.e., the head of screw 20 provides for only clockwise rotation by a screwdriver, counter clockwise rotation is not possible. Attaching member 12 may be connected to locking box member 11 by welding or any other approximate means. In this embodiment, attaching member 12 comprises a single flange member.

Figure 4:
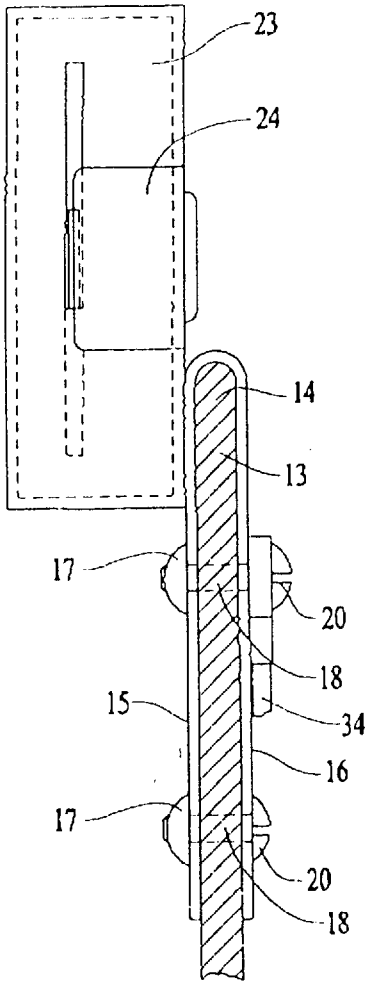
FIG. 4 is a side elevation view of the lock shown in FIG. 1.
Figure 3:
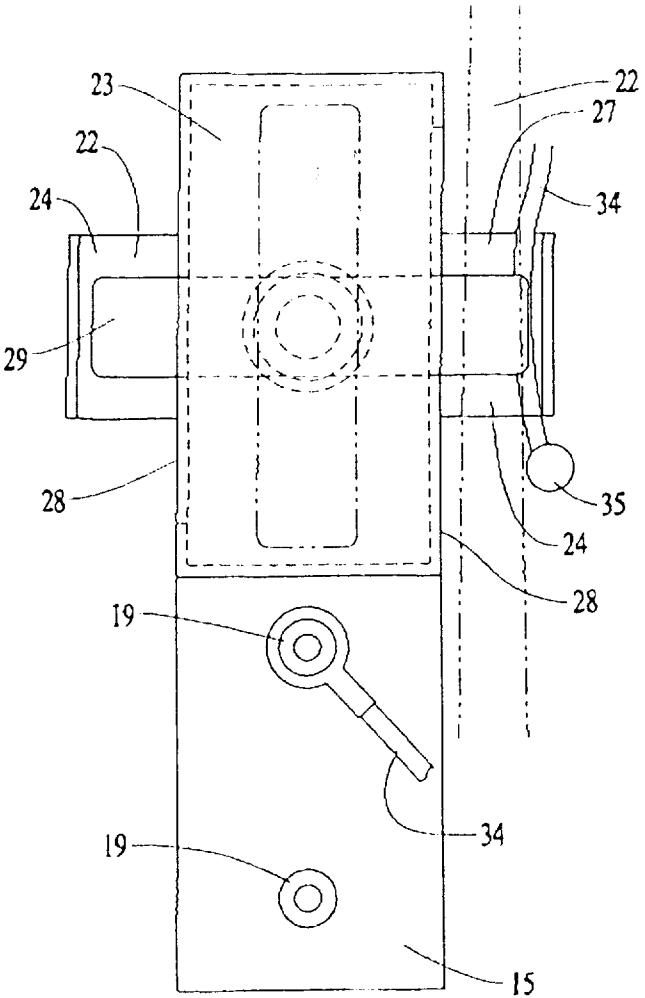
FIG. 3 is back elevation view of the lock shown in FIG. 1.

Locking box member 11 comprises a central housing member 23 having an arm member 24 extending from each side thereof As seen in FIG. 4, each arm member 24 is bent curved or formed so as to comprise two sides 25 and 26 of a slot 27. A third side 28 of slot 27 comprises a side wall of housing member 23. Alternatively, the arm member 24 may include a slot or opening which is not dependent upon the side wall of housing 23. The depth and breadth of slot 27 is such that it accommodates only the narrow end 22 of a golf club shaft. It is well known that a golf club shaft has a thick grip and which tapers down to the narrow end 22 just under the head of the golf club. The breadth and depth of slot 27 utilizes this standard feature of every golf club shaft. The size of slot 27 is smaller than the grip end of a shaft to accommodate only the narrow end of a golf club shaft. By extending the length of arm member 24, two slots 27 can be provided on each side of central housing member 23. In this manner four golf clubs can be secured by the apparatus 10.

The housing member of lock box apparatus 11 houses a key activated lock 31. Locking bar 29 is attached internally to lock 31 and only turns when key 30 is turned. In the unlocked position, locking bar 29 is contained within housing 23. When key 30 is turned, locking bar 29 rotates ninety degrees from its unlocked position and covers the entrance to slot 27. When in this position, the golf club in slot 27 cannot be removed. An opening 32 through the side wall 28 of housing 23 further allows for rotation of locking bar 29. In lieu of a rotatable bar, the lock 31 may be attached to a hinged front member 33 which when unlocked opens slot 27.

A novel feature of locking apparatus 10 is that it also provides anti-theft protection of the entire golf bag—A cable 34 is attached to the inside head of nut 17. Cable 34 may have a length of 2–4 feet. The non-attached end of cable 34 is provided with a circular ball 35 having a diameter greater than the size of slot 27. The secure a golf bag, cable 34 is extended away from the golf bag 13 and looped around a convenient post. Then the ball end 35 is inserted in one of slots 27. With the locking bar 29 in the locked position, the cable 34 is locked within a slot 27 thereby securing the entire golf bag 13.

The portions of the locking apparatus which come into contact with the golf clubs may be lined or covered with a material which prevents marring or scratching to the golf club. While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breach and scope of the claims here appended.

I claim:

1. A securing device comprising:

a rigid central housing;

a contoured first arm extending from a first side of said central housing, said first arm shaped to cooperate with said first side to form a first elongated retention slot;

a contoured second arm extending from a second side of said central housing, said second arm shaped to cooperate with said second side to form a second elongated retention slot;

a locking cylinder pivotally mounted within said central housing, said cylinder oriented perpendicular to the axis of said retention slots;

a locking bar rigidly mounted to said locking cylinder and extending orthogonally therefrom; and an attachment member secured to a third side of said central housing, said attachment member adapted to be fastened to a golf bag, whereby said locking bar pivots in tandem with said locking cylinder, and said first and second arms are constructed and arranged to cooperate with said locking bar and said central housing sides to form a first bounded region and a second bounded region when said locking cylinder is pivoted into a securing orientation.

2. The securing device of claim 1, wherein:

said attachment member includes a first leg spaced apart from a second leg, said first and second legs being adapted to straddle an upper portion of a golf bag sidewall.

3. The securing device of claim 2, wherein:

said attachment member includes a first aperture disposed within said first leg and a second aperture disposed within said second leg, said first and second apertures being coaxial.

4. The securing device of claim 3 further including:

a fastening member passing simultaneously through said first leg aperture, a wall of a golf bag, and said second leg aperture.

5. The securing device of claim 3, further including:

a flexible cable having a fixed first end and a free second end, said second end having a maximum outer dimension that is larger than a maximum inner dimension of said first and second bounded regions.

6. The securing device of claim 5, wherein:

said maximum inner dimension of said first and second bounded regions is larger than an outer diameter of a golf club shaft portion, said maximum inner dimensions being smaller than an outer diameter of a golf club handle portion.

7. The securing device of claim 6, wherein:

said locking bar has a major axis that is co-planar with a major axis of said central housing when said locking cylinder is pivoted into an unlocked position, whereby a golf club may be inserted into and removed from said bounded regions.

8. The securing device of claim 7, wherein:

said locking bar is substantially concealed by said central housing when said locking cylinder is pivoted into an unlocked position.

9. In combination with a golf bag, a golf club securing device, said securing device comprising:

a rigid central housing;

a contoured first arm extending from a first side of said central housing, said first arm shaped to cooperate with said first side to form a first elongated retention slot;

a contoured second arm extending from a second side of said central housing, said second arm shaped to cooperate with said second side to form a second elongated retention slot;

a locking cylinder pivotally mounted within said central housing, said cylinder oriented perpendicular to the axis of said retention slots;

a locking bar rigidly mounted to said locking cylinder and extending orthogonally therefrom; and an attachment member secured to a third side of said central housing, said attachment member constructed and arranged such that said attachment member simultaneously engages an outer surface of a golf bag and an inner surface of said golf bag;

whereby said locking bar pivots in tandem with said locking cylinder, and said first and second arms are constructed and arranged to cooperate with said locking bar and said central housing sides to form a first bounded region and a second bounded region when said locking cylinder is pivoted into a securing orientation.

10. The securing device of claim 9, wherein:

said first and second bounded regions each has a maximum inner dimension, said maximum inner dimension being larger than an outer diameter of a golf club shaft portion, said maximum inner dimensions being smaller than an outer diameter of a golf club handle portion.

11. The securing device of claim 10, wherein:

said attachment member is a U-shaped strap characterized by a first leg spaced apart from a second leg, said attachment strap being adapted to straddle an upper portion of a golf bag sidewall.

12. The securing device of claim 11, wherein:

said attachment member includes a first aperture disposed within said first leg and a second aperture disposed within said second leg, said first and second apertures being coaxial.

13. The securing device of claim 12 further including:

a fastening member passing simultaneously through said first leg aperture, a wall of a golf bag, and said second leg aperture.

14. The securing device of claim 13, further including:

a flexible cable having a fixed first end and a free second end, said second end having a maximum outer dimension that is larger than a maximum inner dimension of said first and second bounded regions.

15. The securing device of claim 14, wherein:

said locking bar has a major axis that is co-planar with a major axis of said central housing when said locking cylinder is pivoted into an unlocked position, whereby a golf club may be inserted into and removed from said bounded regions.

16. The securing device of claim 15, wherein:

said locking bar is substantially concealed by said central housing when said locking cylinder is pivoted into an unlocked position.

* * * * *